US005515798A

United States Patent [19]

Cahuzac

[11] Patent Number: 5,515,798

[45] Date of Patent: May 14, 1996

[54] STITCHING HEAD INCLUDING NEEDLE GUIDE FOR PRODUCING A REINFORCEMENT IN A COMPOSITE COMPONENT

[75] Inventor: Georges Cahuzac, Le Bouscat, France

[73] Assignee: Aerospatiale Societe Nationale Industrielle, Paris, France

[21] Appl. No.: 421,552

[22] Filed: Apr. 13, 1995

[30] Foreign Application Priority Data

Apr. 18, 1994 [FR] France ..... 94 04534

[51] Int. Cl.[6] ..... D05B 55/06; D05B 85/00

[52] U.S. Cl. ..... 112/470.12; 112/224; 112/227

[58] Field of Search ..... 112/80.01, 80.02, 112/80.05, 80.16, 80.4, 80.45, 224, 227, 235, 225, 470.12, 63, 475.01, 93; 28/115; 428/102, 113

[56] References Cited

U.S. PATENT DOCUMENTS

| | | | |
|---|---|---|---|
| 381,997 | 5/1888 | Harris | 112/80.05 |
| 612,011 | 10/1898 | Blanchard | 112/235 X |
| 3,263,631 | 8/1966 | Freeman | 112/80.16 X |
| 3,322,868 | 5/1967 | Kruse et al. | 264/45 |
| 3,425,884 | 2/1969 | Brinkema | 156/161 |
| 3,500,776 | 3/1972 | Card | 112/224 X |
| 3,955,602 | 5/1976 | King | 139/11 |
| 4,038,440 | 7/1977 | King | 428/245 |
| 4,080,915 | 3/1978 | Bompard et al. | 112/475.01 X |
| 4,218,276 | 8/1980 | King | 156/92 |
| 5,429,853 | 7/1995 | Darrieux | 112/475.01 X |

FOREIGN PATENT DOCUMENTS

| | | |
|---|---|---|
| 0284497 | 9/1988 | European Pat. Off. . |
| 0547738 | 6/1993 | European Pat. Off. . |
| 2355936 | 1/1978 | France . |
| 2395340 | 1/1979 | France . |
| 2531459 | 2/1984 | France . |
| 3712013 | 10/1988 | Germany . |
| 2159460 | 12/1985 | United Kingdom . |

*Primary Examiner*—Ismael Izaguirre
*Attorney, Agent, or Firm*—Marshall, O'Toole, Gerstein, Murray & Borun

[57] ABSTRACT

The present invention relates to a stitching head, which can be used in a machine for producing a reinforcement in the form of a sheet for a composite component formed by said reinforcement embedded in a cured matrix, said reinforcement comprising superposed plies of thread through which passes a consolidating thread, said head including a support carrying, on the one hand, means of linkage to the machine and, on the other hand, a needle as well as means for guiding the consolidating thread right to said needle.

According to the invention, said stitching head (P) includes, associated with said needle (33), a device (43, 50) for compacting said superposed plies of thread.

5 Claims, 5 Drawing Sheets

STITCHING HEAD INCLUDING NEEDLE GUIDE FOR PRODUCING A REINFORCEMENT IN A COMPOSITE COMPONENT

BACKGROUND OF THE INVENTION

The present invention relates to a stitching head, which can be used in a machine for producing a reinforcement in the form of a sheet for a composite component formed by said reinforcement embedded in a cured matrix, said reinforcement including superposed plies of thread (especially carbon, glass or boron thread) and to a machine comprising such a stitching head.

More particularly, although not exclusively, such composite components are used in the aeronautical and space fields by virtue of their excellent properties of resistance to mechanical and/or thermal stresses.

Many methods and machines are known for obtaining said composite components and, especially, their reinforcement. In general, the first step is to produce the reinforcement from fibers (threads), in particular inorganic fibers, distributed in at least two directions, after which the material of the matrix in injected into the reinforcement and said material is cured in order to form said matrix and, thus, said composite component.

A description is given, for example in the Applicant's Patent EP-B-0,284,497, of a method and a machine for producing a reinforcement for a composite component formed by said reinforcement embedded in a cured matrix, said reinforcement including superposed plies of thread, according to which method:

at least some of said plies are produced by laying down straight portions of thread, forming part of a continuous thread, on a support, pulling tight each thread portion between two points for positionally fixing the ends of said portion, the ply thus consisting of portions of thread extending at least substantially in a parallel fashion with respect to each other, and the portions of thread of said ply extending in a direction which is either parallel or crossed with respect to the direction of the portions of thread of any other ply in the reinforcement; and all the superposed plies are consolidated by stitching, without knotting, a continuous thread passing through said plies.

In this case, in order to lay down the straight portions of thread constituting the corresponding plies, a special device is used which comprises a tube, open at its lower end and having an opening at its upper part, for the passage of a continuous thread. This laying-down head allows each thread portion to be pulled tight between points for positionally fixing its ends, these fixing points being formed by pins temporarily implanted in the support made of a material which can be penetrated by said pins, such as a foam of synthetic material. After forming the superposed plies of thread and after consolidating said plies, the pins are removed from the support.

As already indicated, the consolidation of all the superposed plies is carried out by stitching, without knotting, a continuous thread passing through said plies, this being achieved by using a stitching head, mounted on said machine, comprising a support carrying, on the one hand, means of linkage to the machine and, on the other hand, a needle as well as means for guiding the consolidating thread right to said needle.

However, in Patent EP-B-0,284,497, this involves producing at least substantially cylindrical reinforcements and, in order to do this, the support is in the form of a likewise cylindrical mandrel. Thus, each ply consisting of straight portions of thread is already compressed by the superjacent ply consisting of a length of continuous thread, wound around said mandrel, which superjacent ply also makes it possible, as required, to compress and compact all the subjacent plies already laid down on the mandrel. The consolidation of the superposed plies by stitching, without knotting, a continuous thread passing through said plies may therefore be performed, as illustrated by FIGS. 10*a* to 10*f* of Patent EP-B-0,284,497, simply by inserting the thread through the plies using the needle, the thread being retained therein in the form of loops because of the very fact that the plies through which it passes are already, by construction, compressed. The consolidating thread reinforces the compaction and compression effect, obtained beforehand when laying down the plies consisting of circumferential lengths of thread, and ensures that all the plies are held together and that the reinforcement has mechanical integrity.

However, when it is desired to produce reinforcements in the form of sheets (plane or curved) from superposed plies each consisting of straight portions of thread, the problem of consolidating the superposed plies is of a different nature.

In fact, in this case, if possible interlacing of the successive plies is disregarded, which is not desirable either for other reasons, the superposed plies are, by construction, not compressed. One solution for solving this problem is mentioned in Patent EP-0,056,351. Here, the reinforcement consists of plies called "warp thread" plies and of plies called "filling thread" plies, these being superposed in parallel planes, the threads of the plies not being mutually interlaced, and the upper ply and the lower ply of the set of plies consisting of "filling" plies. Consolidation of said "warp" and "filling" plies is achieved by means of binding threads which pass through these plies, going around the filling threads of the external (upper and lower) plies so as to form, together with them, a typical fabric trapping the internal warp and filling plies.

It should be noticed that, in this case, the compaction of the warp and filling plies is solely achieved by tensioning the binding threads. Indeed, as they are arranged, the binding threads require, obviously, a shuttle in order to lay them down, which necessitates the plies having a low "density" of the warp and filling threads (or a large spacing between these threads), as well as a small thickness, this consequently requiring a tension to be exerted on the binding threads in order to hold in place and to compact the warp and filling threads. Such a tension runs the risk, of course, of breaking the binding threads which are by nature fragile. Moreover, the solution indicated hereinabove finally results in producing, at least in part, a typical fabric by interlacing the filling threads of the external plies and the binding threads, these being in fact equivalent to warp threads.

SUMMARY OF THE INVENTION

The object of the present invention is to overcome these drawbacks and relates to a stitching head, which can be used in a machine for producing a reinforcement in the form of a sheet for a composite component, by means of which the mechanical integrity of the reinforcement is provided without it being necessary, in order to achieve this, to produce a kind of "fabric" of interlaced filling threads and binding threads.

For this purpose, the stitching head, which can be used in a machine for producing a reinforcement in the form of a sheet for a composite component formed by said reinforcement embedded in a cured matrix, said reinforcement comprising superposed plies of thread through which passes a consolidating thread, said head including a support carrying, on the one hand, means of linkage to the machine and, on the other hand, a needle as well as means for guiding the consolidating thread right to said needle, is noteworthy, according to the invention, in that said stitching head includes, associated with said needle, mechanical means for compacting said superposed plies of thread.

Thus, the mechanical integrity of the reinforcement is solely obtained by the friction of the consolidating thread on the portions of thread constituting the superposed plies, without applying stress on said consolidating thread, this being achieved by means of the prior compaction of the superposed plies in order to reach a sufficient density of the portions of thread constituting them.

Advantageously, said mechanical compaction means include a presser-foot actuated in conjunction with the movement of said needle.

Preferably, said stitching head has a rotary support at the lower end of which said needle, associated with the presser-foot, is mounted.

According to a first embodiment, said needle is hollow and a thread-guiding channel connected to said needle passes through said rotary support.

In this case, advantageously, said stitching head comprises a spring mechanism, controlling the presser-foot, including a linkage bar pushed downward by a compression spring and retained by a stop in contact with the support of the needle.

According to a second embodiment, said needle has an oblique through-eye and is associated with a thread-guide comprising a body through which passes obliquely a channel for passage of the thread, the lower end of said channel being flared.

In this case, preferably, said stitching head comprises a mechanism for actuating the presser-foot/thread-guide/needle assembly, consisting of a first cylinder actuator actuating a plate on which said assembly is mounted, a spindle carrying the thread-guide and a second cylinder actuator actuating the presser-foot.

In particular, said needle may be held in position on said plate by means of a support, using a conical clamp tightened by a nut.

Moreover, the spindle carrying the thread-guide may be stressed by a tensioning spring and retained by a stop.

DESCRIPTION OF THE DRAWINGS

The figures of the appended drawing will make it clear how the invention may be realized. In these figures, identical references designate similar elements.

DETAILED DESCRIPTION OF THE PREFERRED EMBODIMENT

Figure 1:
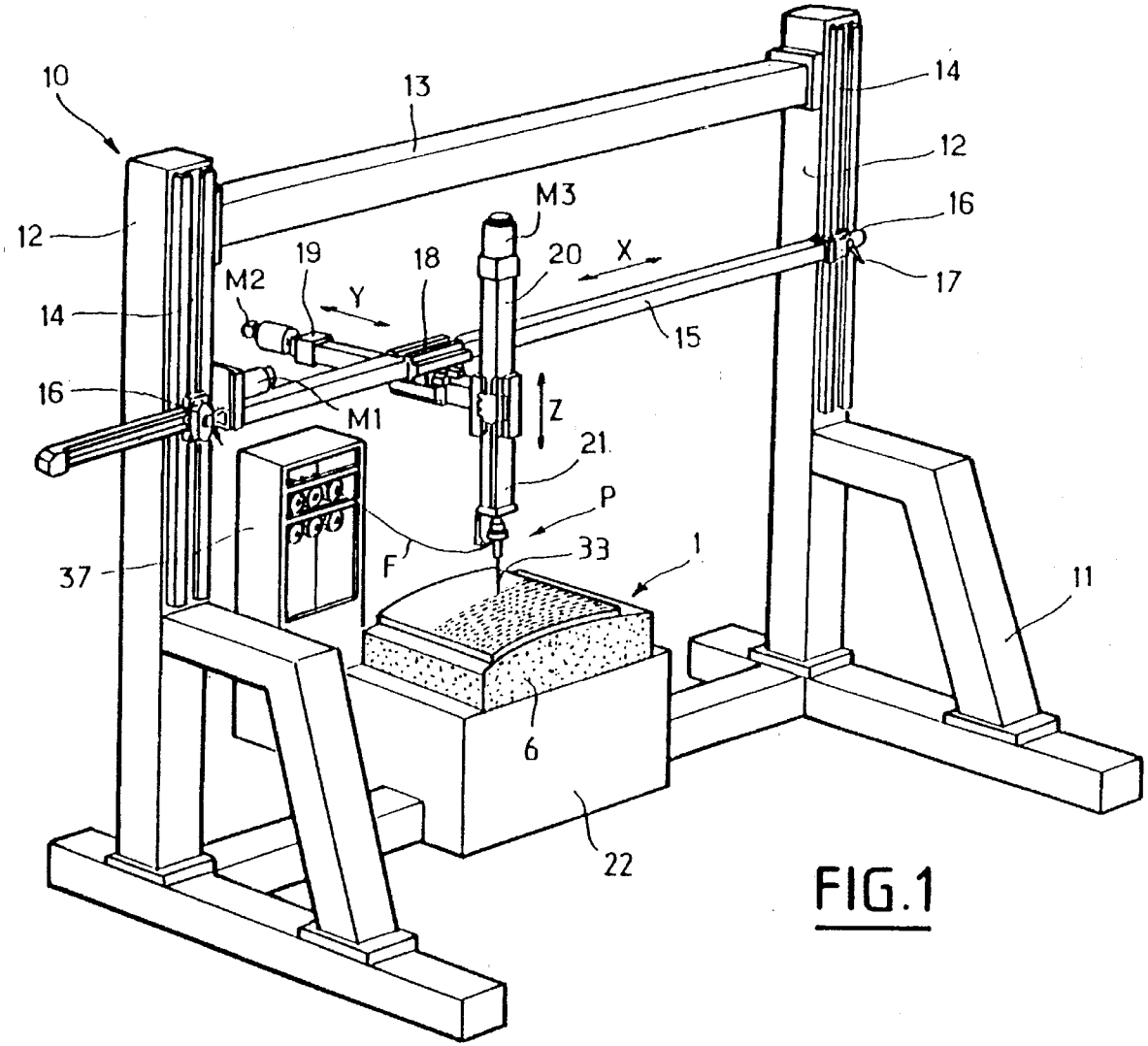
FIG. 1 shows diagrammatically, in perspective, an example of a machine for producing a reinforcement in the form of a sheet for a composite component.

The machine 10 of FIG. 1, described in Patent EP-B-0, 284,497, comprises a stand provided with a subframe 11 and with vertical uprights 12 joined at their upper part by a horizontal crosspiece 13.

Each vertical upright 12 comprises a slideway 14 and a transverse bar 15 is fixed near its ends in slides 16 mounted in the slideways 14 in which they can be immobilized by screws 17. By virtue of this arrangement, it is possible to adjust the height of the bar 15 on the uprights 12.

Mounted on the bar 15 is a carriage 18 on which is provided a horizontal arm 19 which can slide transversely and adjustably with respect to the bar 15.

At one of its ends, the horizontal arm 19 carries a vertical arm 20 which is also mounted in a sliding and adjustable manner.

At its lower end 21, the vertical arm 20 comprises fixing means adapted to receive a stitching head P.

The machine includes, in addition, a base 22 supporting a support 6 for a reinforcement 1, this support having the shape of a convex sheet. This reinforcement 1 may advantageously be produced, as described elsewhere in French Patent Applications, in the name of the Applicant Company, which were filed on Apr. 18, 1994 under the titles "Method and machine for producing a reinforcement for a composite component" and "Method and machine for producing a reinforcement in the form of a sheet for a composite component".

It should be noted that, in FIG. 1, the plies have already been laid down and that the stitching head P is in the process of carrying out the consolidation of the superposed plies.

It should be understood that, by virtue of the arrangement of the bar 15 and of the arms 19 and 20, the end 21 may be adjusted to any desired position with respect to the support 6, along three orthogonal axes X, Y and Z by means of motors M1, M2 and M3 which are depicted, by way of example, mounted on the bar 15 and at the ends of the arms 19 and 20 and drive these along these three axes by means of suitable known systems based on a rack and pinion, a worm or other means.

Figure 2:
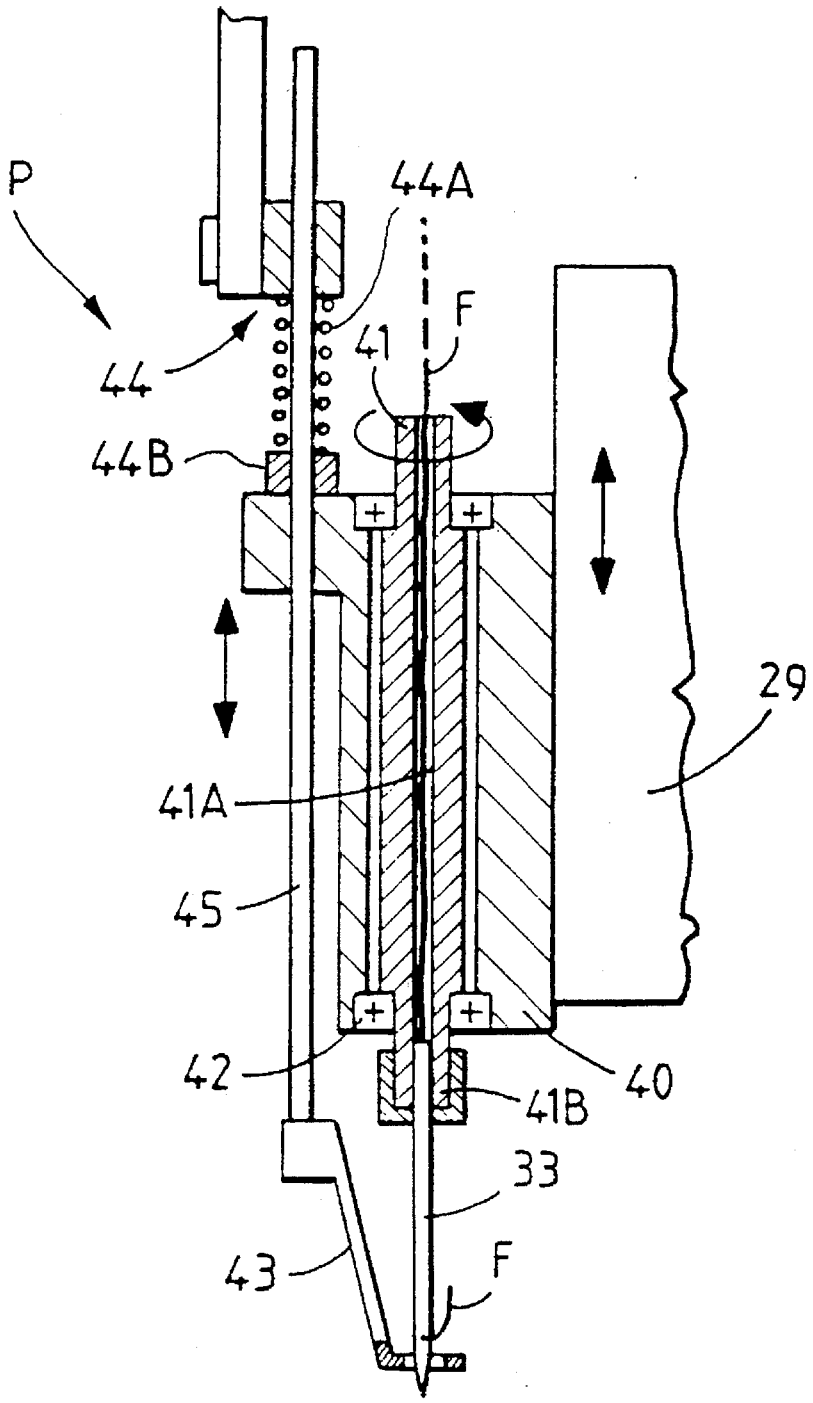
FIG. 2 is a diagrammatic view, in section, illustrating a first embodiment of a stitching head according to the invention.

A first embodiment of a stitching head P is depicted in FIG. 2. In order to allow the to-and-fro motion of the needle 33 with respect to the support 6 (in order to lay down the successive portions of thread of one ply), provision is made, as is seen in FIG. 2, for a support 40, mounted on the block 29, connected to the machine 10, in which is arranged a guide 41, able to rotate on bearings 42 by virtue of driving means which are not depicted, through which guide passes a longitudinal channel 41A for the passage of the thread F payed off from the bobbins (FIG. 1) and the lower end 41B of which guide carries the needle 33. In addition, as also shown in this FIG. 2, a presser-foot 43 is associated with the needle 33, which presser-foot may be set in a motion parallel to the longitudinal extension of the needle using a spring mechanism 44. More particularly, the spring mechanism 44, controlling the presser-foot 43, includes a linkage bar 45, pushed downward by a compression spring 44A and retained by a stop 44B in contact with the support 40 of the needle 33 when the needle is outside the laid down plies. When the needle 33 descends, the presser-foot 43 is retained by the plies and the spring 44A exerts a compressive force on the plies.

Figure 3:
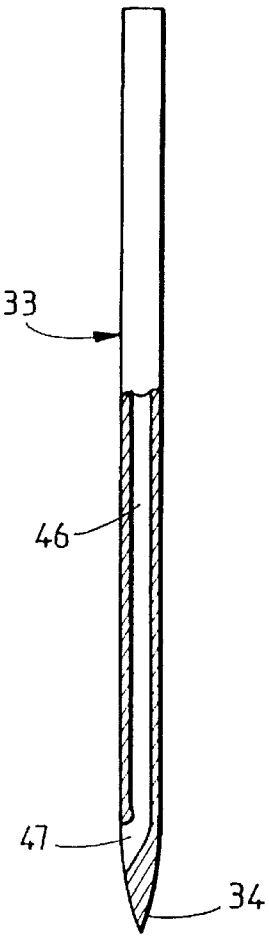
FIGS. 3 and 4 are views, in longitudinal section, of two embodiments of the needle used in the stitching head of the invention.

As illustrated in FIG. 3, the needle 33 may be a hollow needle through which passes an axial channel 46, for passage of the thread, and which includes a non-through eye 47 into which the channel 46 emerges laterally and obliquely.

Figure 4:
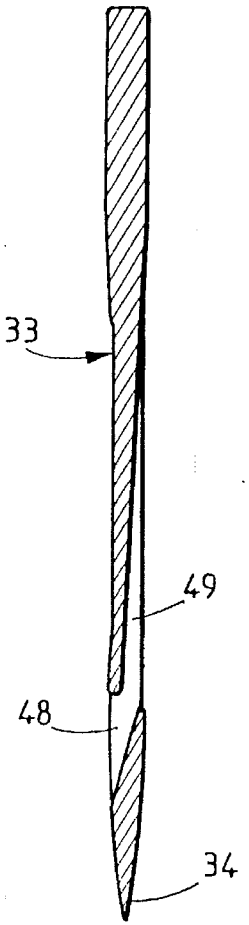

However, the needle 33 may advantageously be as depicted in FIG. 4, that is to say it comprises an oblique through-eye 48 emerging into a longitudinal groove 49 of cross section in the form of a circular arc, the depth of which groove decreases progressively on going away from the tip 34 of the needle and through which groove the needle is intended to pass.

Figure 5:
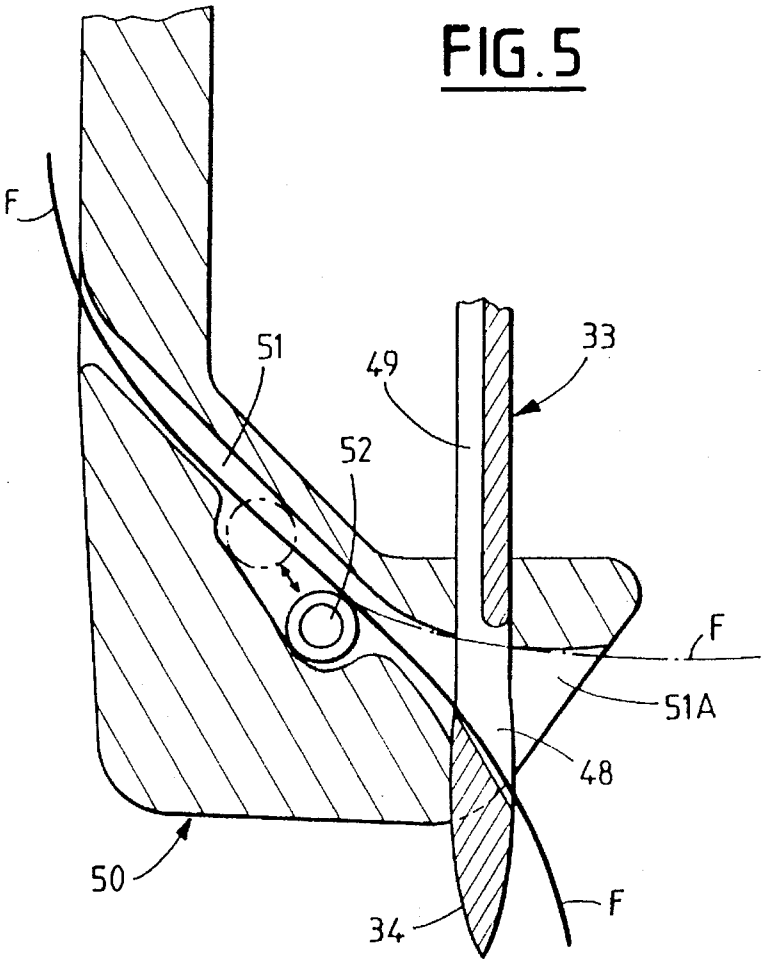
FIG. 5 shows, in section, a thread-guide for the needle of FIG. 4.

When this latter needle is used, a special thread-guide may be provided, as shown in FIG. 5. The thread-guide has a body 50, substantially in the form of an L, through which passes obliquely a channel 51 for the passage of the thread F, the lower end 51A of said channel being flared in order to allow the thread to be guided, either substantially vertically or substantially horizontally (thread F depicted by the dot-dash lines), as will be seen in more detail below. A wheel 52 releases the thread F, by advancing into the channel 51, and traps it, by moving back into said channel. In fact, it is the sliding of the thread which, on pulling downward, makes the wheel 52 rotate, opening the channel 51, whereas a rearward motion ("rise" of the thread) blocks the thread once again.

Figure 6:
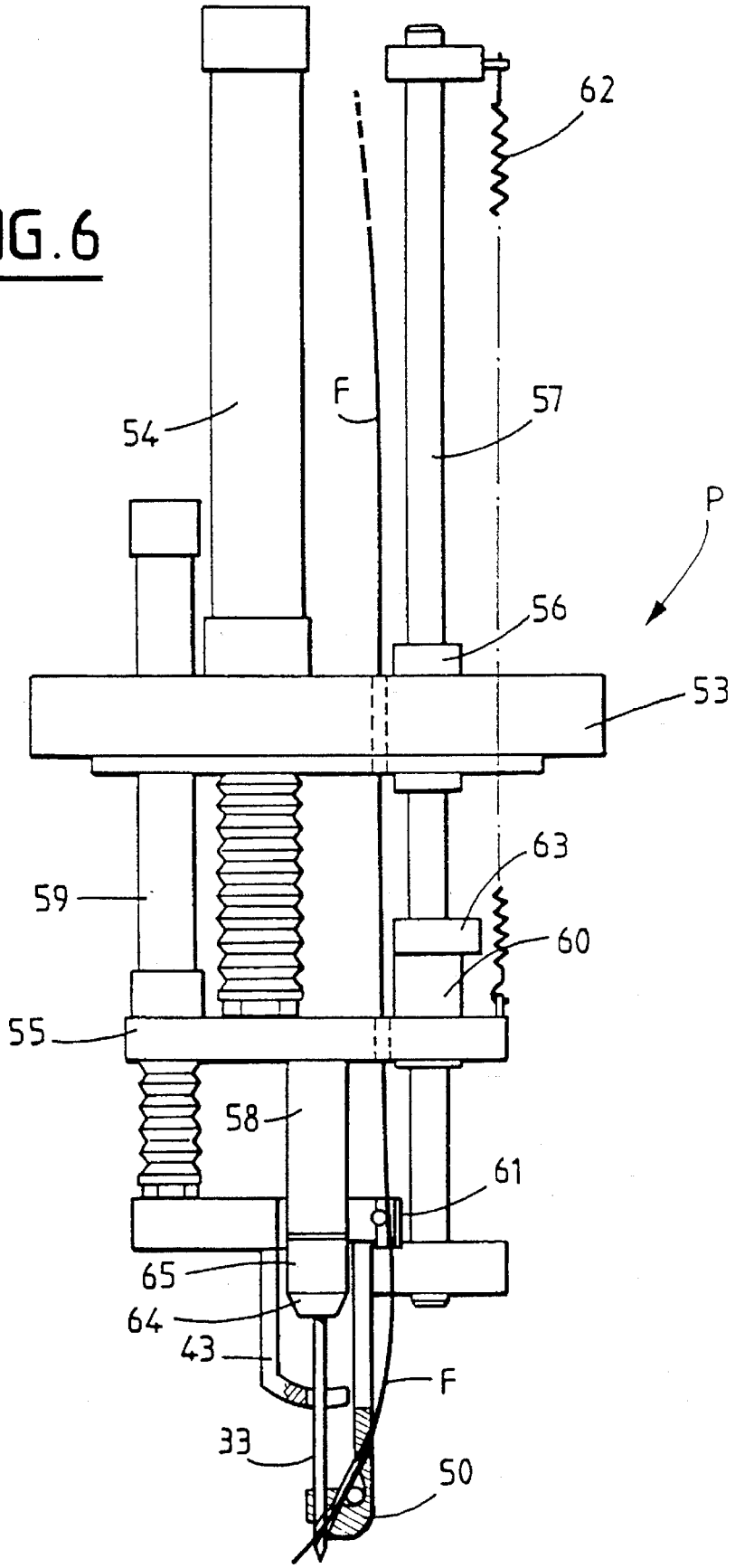
FIG. 6 illustrates diagrammatically a second embodiment of a stitching head according to the invention, equipped with a thread-guide according to FIG. 5.

In FIG. 6, a second embodiment of a stitching head is shown which comprises the presser-foot 43/thread-guide 50/needle 33 assembly (FIG. 4). A pneumatic cylinder actuator 54, which actuates a plate 55, is screwed onto a circular flange 53 which may be fixed to the tool holder of the machine 10. Moreover, the flange 53 carries a bush 56 with balls for guiding a spindle 57. The plate 55 itself carries a support 58 for the needle 33, an auxiliary cylinder actuator 59 and a second bush 60 with balls sliding on the spindle 57. The auxiliary cylinder actuator 59 carries the presser-foot 43 and a thread-gripper 61 (similar to the thread-guide 50) for the thread F, while the guiding spindle 57 carries the thread-guide or thread-gripper 50, being stressed by the tensioning spring 62 and retained by a stop 63. The needle 33 is held in position on the support 58 using a conical clamp 64 tightened by a nut 65.

Figure 7A:
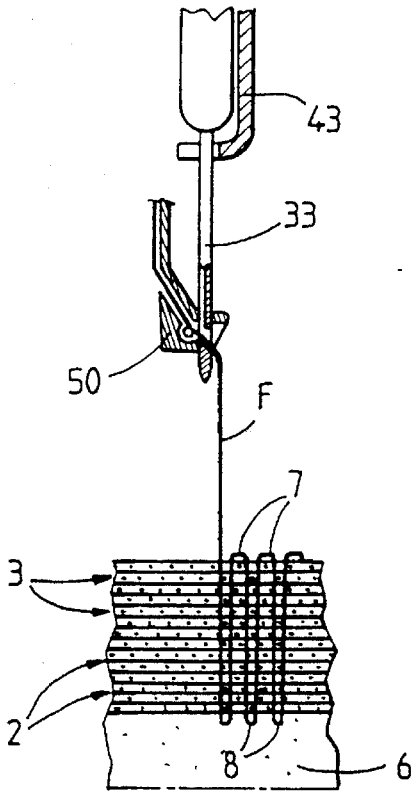
FIGS. 7A to 7D illustrate diagrammatically the procedure for consolidating the superposed plies of the reinforcement produced in accordance with the invention.
Figure 7B:
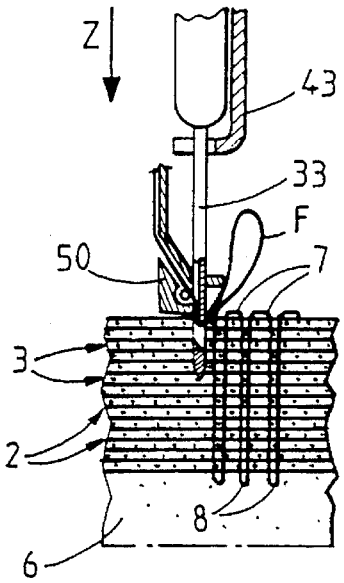
Figure 7C:
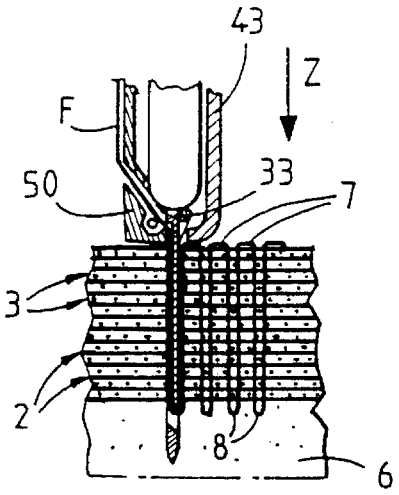
Figure 7D:
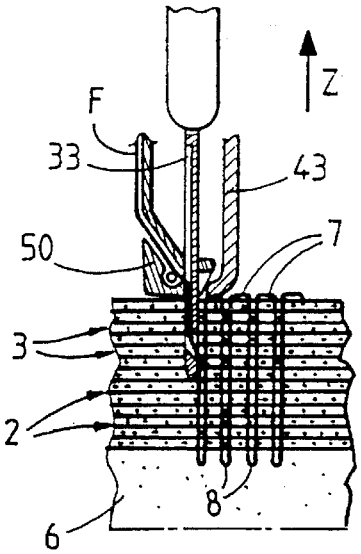

In order to consolidate the superposed plies 2, 3 of the reinforcement 1, stitching is performed, as shown in FIGS. 7A to 7D, in the Z direction. In order to do this, while inserting the needle 33 into the plies 2, 3, the thread F is driven by said needle through the plies 2, 3 (FIG. 7B), the thread-gripper (not depicted in FIGS. 7A to 7D) being tightened up and the travel of the needle being adjusted so as to penetrate into the support 6. As the needle 33 is being withdrawn from the plies 2, 3, the thread-gripper is slackened off and the needle moves out, progressively releasing the thread F through the plies 2, 3, thus forming a nonclosed loop 8 which is retained solely by the foam forming the support and by the friction of the thread in the plies 2 and 3 (FIGS. 7C, 7D).

Thus, it is by virtue of the elastic pressure of the foam closing up over the loop after the needle has been withdrawn on the one hand, and of the friction and gripping in the plies 2, 3 on the other hand, that, when the needle has been withdrawn, the thread F, which passes freely through the needle during this withdrawal, is retained in order to form the open loop 8.

After it has been removed from the plies 2 and 3, the needle is moved up above the surface of said plies by a distance equal to the thickness to be stitched plus the stitching pitch 7, that is to say the spacing desired between two stitches (FIG. 7A).

The thread-gripper is then actuated in order to lock the thread in the needle, the stitching head is moved by one pitch and the device is once again actuated in order to restart the cycle so as to form continuously a large number of loops with the same thread F, that is to say in order to form the stitches 8 of one row. The row of the next loops is brought about after a relative displacement of the needle 33 with respect to the reinforcement 1.

More specifically, as may be seen in FIGS. 7A–7D, starting from the initial (and final) position shown in FIG. 7A, in which the presser-foot 43 has just been raised, the stitching head is lowered (in the way described hereinbelow with regard to FIG. 6) in order to form a loop 8 of thread during the descent of the needle 33 through the superposed plies 2, 3. It should be pointed out that, at this moment, the thread-guide 50 is stopped in contact with the uppermost ply (FIG. 7B). Since the needle 33 is in its lowermost position (FIG. 7C), the presser-foot 43 in turn bears on the uppermost ply of the superposed plies 2, 3, trapping the loop 8. It is this combined action of the pressing of the thread-guide 50 and, most especially, of the presser-foot 43 which ensures compaction of the superposed plies, which then have a density of the portions of thread constituting them which is sufficient to retain the ply-consolidating thread by means of friction. Since the presser-foot 43 remains in contact with the uppermost ply as the needle 33 rises (FIG. 7D), the thread slides in the eye of the needle which remains in place.

Now also in relation to FIG. 6, the needle 33 is lowered by the cylinder actuator 54 which descends, driving the plate 55 and therefore all the components fixed to said plate. At the start of this descent, that is to say before the needle 33 penetrates into the superposed plies 2, 3, the thread F is held in place by the thread-gripper 61 and the thread-guide 50, also acting as a thread-gripper, and forms a loop (FIG. 7A).

When the needle 33 penetrates into the plies 2, 3, the thread-guide 50 comes into contact with these plies, immobilizing the spindle 57, and the thread F slides through the thread-guide 50, while the previously formed loop of thread is pushed into the plies (FIG. 7B). When the needle 33 has reached its lowermost position (FIG. 7C), the presser-foot 43 is brought into contact with the uppermost ply by actuation of the cylinder actuator 59 in order to lower it, this ensuring compaction of the superposed plies, and then the rise of the cylinder actuator 54, and thus of the needle 33, is initiated (FIG. 7D).

While the needle 33 is rising through the plies (2, 3), the presser-foot 43 remains pressed against these plies under the thrust of the associated cylinder actuator 59. The thread is then gripped by the thread-grippers. When the stop 63 comes back into contact with the bush 60, the thread-guide 50 rises up with the needle 33 and the thread slides in the former. The end of the rise of the needle 33 initiates the rise of the presser-foot 43. The thread is gripped by the thread-guide 50 and slides through the upper thread-gripper 61.

I claim:

1. A stitching head for a machine producing a reinforcement in the form of a sheet for a composite component formed by said reinforcement embedded in a cured matrix, said reinforcement comprising superposed plies of thread through which passes a consolidating thread, and said head including:

a support mounted on said machine;

a rotary support at the lower end of which is mounted a reciprocated needle having an oblique through-eye;

a thread-guide having a channel for passage of the thread, said channel being disposed obliquely with regard to said needle and the lower end of said channel being flared;

a presser-foot actuated in conjunction with the reciprocated needle for compacting said superposed plies of thread; and a spring mechanism biasing said presser-foot.

2. The stitching head of claim 1, wherein said spring mechanism includes a linkage bar pushed downward by a compression spring and retained by a stop in contact with said support of the needle.

3. The stitching head of claim 1, additionally comprising an actuator mechanism having a first cylinder actuator actuating an assembly plate, a spindle carrying said thread-guide, and a second cylinder actuator actuating said presser-foot.

4. The stitching head of claim 3, wherein said needle is held in position on said plate by a support, using a conical clamp tightened by a nut.

5. The stitching head of claim 3, wherein said spindle carrying said thread-guide is stressed by a tensioning spring and retained by a stop.

* * * * *

UNITED STATES PATENT AND TRADEMARK OFFICE

CERTIFICATE OF CORRECTION

PATENT NO. : 5,515,798

DATED : May 14, 1996

INVENTOR(S) : Georges Cahuzac

It is certified that error appears in the above-identified patent and that said Letters Patent is hereby corrected as shown below:

On the title page:
Item [30], 94 04534 should be --94 04584--

Signed and Sealed this

Twenty-second Day of October, 1996

Bruce Lehman

*Attest:*

BRUCE LEHMAN

*Attesting Officer*

*Commissioner of Patents and Trademarks*